US005961050A

United States Patent [19]

Kitajima

[11] Patent Number: 5,961,050

[45] Date of Patent: Oct. 5, 1999

[54] AIR BRUSH

[75] Inventor: Katsuaki Kitajima, Nagano-ken, Japan

[73] Assignee: B.B. Rich Co., Ltd., Nagano-ken, Japan

[21] Appl. No.: 08/943,905

[22] Filed: Oct. 3, 1997

[30] Foreign Application Priority Data

May 19, 1997 [JP] Japan ..... 9-128489

[51] Int. Cl.[6] ..... B05B 7/30

[52] U.S. Cl. ..... 239/346; 239/375; 239/433; 239/600

[58] Field of Search ..... 239/340, 341, 239/346, 375, 379, 369, 409, 416, 416.4, 416.5, 417, 420, 433, 530, 586, 583, 600

[56] References Cited

U.S. PATENT DOCUMENTS

| | | | |
|---|---|---|---|
| 817,819 | 4/1906 | Walkup | 239/340 |
| 1,703,359 | 2/1929 | Paasche | 239/346 |
| 2,014,942 | 9/1935 | Lemoine | 239/600 |
| 2,264,564 | 12/1941 | Connor | 239/346 |
| 2,550,404 | 4/1951 | Chasan et al. | 239/346 |
| 4,161,289 | 7/1979 | Rebold | 239/346 |
| 5,779,157 | 7/1998 | Robisch et al. | 239/346 |

*Primary Examiner*—Andres Kashnikow
*Assistant Examiner*—Lisa Ann Douglas
*Attorney, Agent, or Firm*—Greenblum & Bernstein P.L.C.

[57] ABSTRACT

The air brush of the present invention has a function to improve a maintenance work characteristic within the air brush main body and capable of selectively realizing a plurality of kinds of blowing injection forms. The air brush main body is separated from between the coating material container and the air supplying port so as to separate into the nozzle container unit at the extremity end of the main body and the residual main body unit, these sections are removably connected at the aforesaid separating section, the aforesaid air brush main body is comprised of one main body unit and a plurality of kinds of nozzle container units and then optional nozzle container units are selectively replaced and installed in respect to the main body unit.

18 Claims, 8 Drawing Sheets

AIR BRUSH

BACKGROUND OF THE INVENTION

1. Field of the Invention

The present invention relates to an air brush.

2. Description of the Related Art

FIG. 12 shows a prior art air brush. This air brush is comprised of an air brush main body 101 which is formed substantially into a pencil shape. The extremity end of the aforementioned air brush main body 101 is provided with a nozzle 102, and a needle 104 for use in opening or closing the nozzle 102 is slidably inserted into and passed along an axial core section of the air brush main body 101.

The needle 104 is slid by an operating lever 105 arranged at a middle part of the air brush main body 101 in an axial core direction to cause compressed air to be injected out of the nozzle 102 at the extremity end of the main body 101. Then, coating material supplied from a coating material container 103 arranged just after the nozzle 102 is blown out together with injection of compressed air so as to perform a fine blowing injection. At the middle part of the air brush main body 101 is arranged an air feeding hose 111 acting as a supplying source for the compressed air or an air supplying port 106 to which an air bomb or the like is connected. The air supplying port 106 is comprised of a connecting section 106*a* and a valve fitting 106*b*.

A connecting cylinder 106*a* formed in a substantially cylindrical shape is connected at its upper end to a middle part of the air brush main body 101, and fixed by soldering or the like and integrally assembled with the main body 101. In addition, an aeration passage 109 is formed within the connecting cylinder 106*a*.

The aeration passage 109 is constructed such that it communicates with an aeration passage 110 formed within the air brush main body 101 toward the nozzle 102 and then the compressed air supplied from an air feeding hose 111 connected to the air supplying port 106 passes through the aeration passages 109 and 110 and is supplied to the nozzle 102.

In addition, to the lower end port of the connecting cylinder 106*a* is connected a valve fitting 106*b* having an air valve 107 installed therein. To the air valve 107 arranged in the valve fitting 106*b* is connected an operating lever 105 arranged at the upper section of the air brush main body 101, the operating lever 105 is pushed down to cause the air valve 107 to be opened to start an air supplying operation, namely a blowing injection of the coating material is started.

In addition, in the case of the air supplying port 106, although the connecting cylinder 106*a* integrally assembled with the air brush main body 101 and the valve fitting 106*b* are connected to each other as shown in FIG. 12, there is provided another configuration in which the air supplying port has the connecting cylinder extended and the air valve is directly installed in it.

As the prior air brushes constructed as described above, four or five different basic types have been developed for respective kinds of application, for use with demands for different sizes or forms of coating material container (for example, a weight type or a suction type) and nozzle port diameter, or when finer air blowing injection work such as precise coating or graphic design is required. Frequently, the most suitable air brush for performing a targeted air blowing injection is selected from four or five types of air brushes at each of the working stages.

Accordingly, it is common for an air brush artist to keep two to five different types of air brushes when several kinds of air brushes are demanded for various coating operations as described above.

However, the use of many air brushes for various kinds of work automatically requires an expenditure. Accordingly, the individual application of different kinds of air brushes requires a general user to bear an economical burden, and this is a substantial hindrance when the air brush is applied at a higher technical level.

In addition, although the aforementioned prior art air brush has a fine elongated aeration passage 110 for supplying compressed air to the nozzle 102, and an insertion passing hole for inserting a needle 104 is punched in the air brush main body 101, it is technically difficult to perform high precision machining for these structures during the manufacturing operation. In particular, it is sometimes found that the aeration passage 110 is elongated and of fine diameter, and inclined with respect to the axial core of the air brush main body 101, requiring troublesome machining operations. Additionally, when maintenance work is carried out for the aeration passage 110 and the pass-through holes in the needle 104, the work must start from the extremity end port and the rear end port of the air brush main body 101, resulting in the difficult and troublesome maintenance operations.

SUMMARY OF THE INVENTION

It is an object of the present invention to improve upon the prior art air brush, wherein the ease of maintenance within the air brush main body is improved, and a plurality of types of air blowing injector may be selected in a minimum configuration.

In order to solve the problem, the air brush of the present invention is constructed such that the extremity end of the air brush main body is provided with a nozzle and a coating material container for supplying coating material to the nozzle, an air supplying port is arranged at the middle part of the air brush main body, the air brush main body is separated from between a mounting section of the coating material container and a mounting section of the air supplying port so as to separate the nozzle container unit at the extremity end of the main body and the residual main body unit, wherein the nozzle container unit and the main body unit are removably connected at the aforesaid separated section.

In accordance with the means, the air brush main body is separated from between the mounting section of the coating material container and the mounting section of the air supplying port so as to enable it to be separated into the nozzle container unit at the extremity end from the divided section and a main body unit at the rear side from the divided section. In addition, the aforementioned nozzle container unit and the main body unit can be removably connected at the divided section.

Accordingly, under a state in which the air brush main body is divided, it becomes possible to perform a maintenance work for the aeration passages or the needle insertion hole from the aforesaid divided section.

The aforesaid air brush may include one main body unit and a plurality of nozzle container units having at least different configurations of coating material containers and a further optional nozzle container unit is constituted in such a way that it may be replaced with and installed in respect to the aforesaid main body unit.

In this case, the air brush itself comprises one main body unit and a plurality of nozzle container units having different configurations of the coating material containers. Then, an optional nozzle container unit is selected in correspondence with the operation to be performed and replaced with and fixed in respect to the main body unit, thereby the blowing injection which is most suitable for the operation is attained.

In addition, the aforementioned air brush may be constructed such that the main body unit and the nozzle container unit separated from the separating section are coaxially arranged to each other and a fixing angle of the aforesaid nozzle container unit around the axial core of the air brush main body can be variably adjusted in respect to the main body unit.

With such an arrangement as above, it becomes possible to make a variable adjustment of the fixing angle of the nozzle container unit in respect to the main body unit. Thus, in the case that the coating material container may act as a hindrance against a blowing injection work in view of a visual angle, the fixing angle of the nozzle container unit is displaced to incline the coating material container to cause the coating material container to be out of the visual angle and an operator can perform a blowing injection while directly seeing the nozzle section.

The aforementioned air brush may be constructed such that an annular air chamber is formed between the connecting surfaces at the separating section of the air brush main body and a separating section communicating part of the aeration passage for communicating between an air supplying port section of the main body unit and the nozzle of the nozzle container unit through the air chamber.

In this case, an annular air chamber is formed between the connecting surfaces of the separating section of the air brush main body. Since the aforementioned air chamber is formed in an annular shape, it may always keep an annular state even if the fixing angle of the nozzle container unit in respect to the main body unit is made variable and then the aeration passage at the nozzle container unit side and the aeration passage at the main body unit side are always communicated to each other.

In addition, the aforementioned air brush is constructed such that a cap member for covering projecting segments is removably connected to a rear section of the main body unit where a rear part of the nozzle opening or closing needle inserted into and passed through an axial core part of the air brush main body and an adjusting screw for adjusting a fixed position of the needle are projected, and then openings for the operation are opened at positions corresponding to the adjusting screw in the aforesaid cap member and the needle rear section.

In accordance with the aforementioned means, an adjusting operation for the needle fixed position required when the nozzle container unit is replaced with an installed can be carried out from the openings arranged in the cap member while holding the adjustment screw and the needle rear section without removing the cap member from the main body unit.

BRIEF DESCRIPTION OF THE DRAWINGS

FIG. 2(*b*) is a sectional view taken along a line II—II in FIG. 2(*a*);

DETAILED DESCRIPTION OF THE PREFERRED EMBODIMENTS

Figure 1:
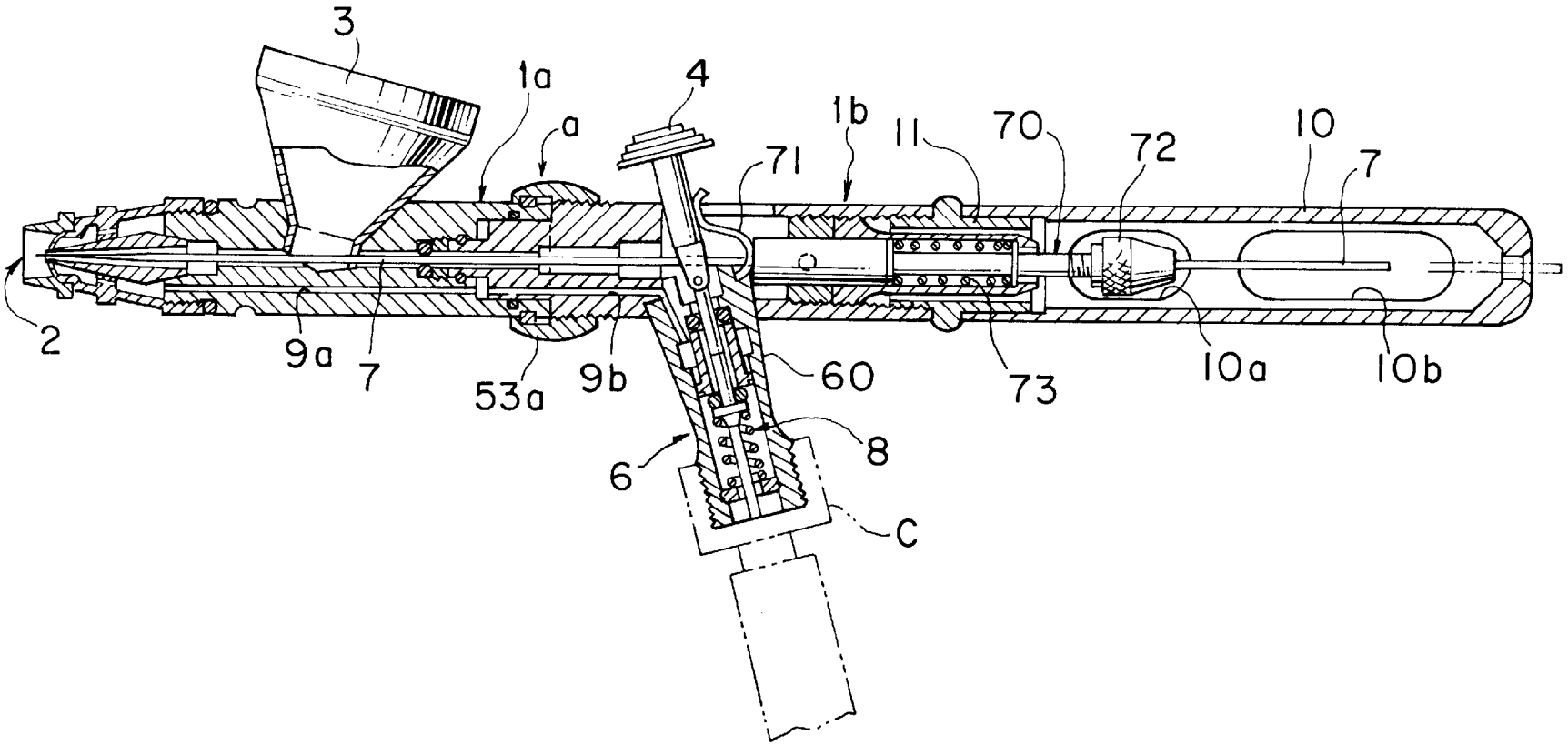
FIG. 1 is a longitudinal section showing an air brush to which the present invention is applied.

Referring now to the drawings, one preferred embodiment of the present invention will be described as follows.

An air brush shown in FIG. 1 is provided with an air brush main body 1 formed in a substantially longitudinal axial form. An extremity end of the tapered air brush main body 1 is provided with a nozzle 2, and a coating material container 3 is mounted just after the nozzle 2. In addition, at the middle part of the air brush main body 1 are arranged: an air supplying port 6 (acting as a compressed air supplying section), an operating lever 4, and a cap member 10 connected to the rear end section of the air brush main body 1.

The air brush is constructed such that the needle 7 for optionally opening or closing the nozzle 2 is inserted so that it may be advanced or retracted and slidably inserted along an axial core section of the air brush main body. The needle 7 is retracted under an operation of the operating lever, and the liquid coating material supplied from the weight-type coating material container 3 arranged at the front part of the air brush main body 1 is blown out of the nozzle 2 along with the injection of the compressed air.

The air brush main body 1 has a separating section (a) between a mounting position of the coating material container 3 and the air supplying port 6. The air brush main body 1 is constructed such that it can be divided into the nozzle container unit 1*a* (at the extremity end side from the separating section (a)) and the main body unit 1*b*. The structure of the separating section (a) will be described later.

The air supplying port section 6 arranged at the middle part of the air brush main body 1 is a connecting port for a compressed air supplying hose (c), an air bomb, or the like, wherein a connecting cylinder 60 is integrally connected to the middle part of the air brush main body 1 and an air valve 8 is internally installed within the connecting cylinder 60.

Figure 2A:
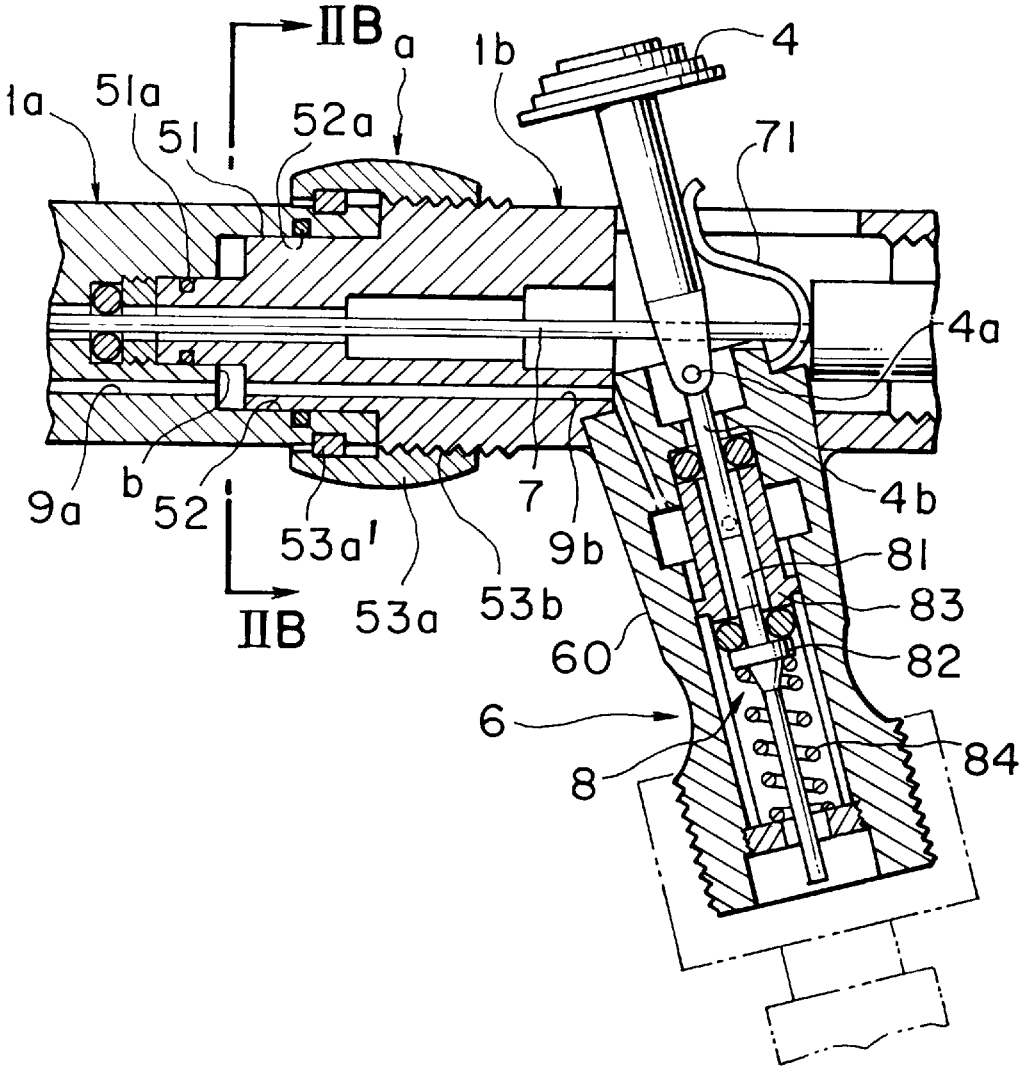
FIG. 2(*a*) is a longitudinal section showing a separated section of the air brush.
Figure 2B:
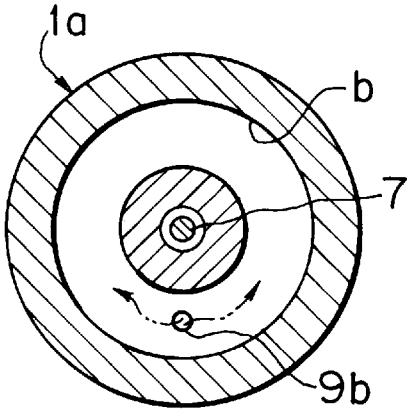

The air valve 8 includes a valve member 82 supported by a valve shaft 81 and a valve seat 83 on which the valve member 82 is seated. The valve member 82 is always biased by a repelling force of a coil spring 84 to be seated against the valve seat 83 (FIG. 2).

The air valve 8 is constructed such that the operating lever 4 at the upper section of the air brush main body 1 may be pushed to cause the valve member 82 to be depressed down, opening the valve. The operating lever 4 is constructed such that a pushing lever 4*b* is connected to its extremity end through a pivot axis 4*a*. The pushing lever 4*b* is fitted to and inserted into an axial core section of the connecting cylinder 60 connected to the air brush main body 1, and the lever is supported in such a way that it may be freely depressed thereby. Additionally, the extremity end of the pushing lever 4*b* abuts the upper end of the valve shaft 81 of the air valve 8. The air valve 8 is opened under a depressing operation of the operating lever 4.

That is, as the air valve 8 is opened under the pushing operation of the operating lever 4, the compressed air flows from the connecting cylinder 60 (acting as the air supplying port) into the air brush main body 1, passes through aeration passages 9*a*, 9*b* arranged in the main body 1, and then is blown out of the nozzle 2.

In addition, the operating lever 4 is supported from the pivot shaft 4*a* in such a way that the lever 4 may be freely bent, e.g., when the lever is pulled in a rearward direction and inclined, the needle 7 is slid in a rearward direction through a needle chuck 70.

The needle 7 inserted into the axial core section of the air brush main body 1 is inserted into and held at the needle chuck 70 fitted along the axial core section of the rear part of the air brush main body 1.

The needle chuck 70 holds and supports the needle 7 in such a way that the needle may be axially advanced or retracted. The needle chuck 70 is constructed to be a substantial tubular shape. The needle chuck 70 is fitted to an axial core section of a rear end part of the air brush main body 1 in such a way that the needle chuck 70 may be slidably advanced or retracted against the axial core section of the rear part of the air brush main body 1. Further, the needle chuck 70 is supported under a state in which its rear end section is slightly projected out of the rear end of the air brush main body 1.

An adjusting screw 72 is threadably fitted to the rear end of the needle chuck 70 projecting out of the rear end of the air brush main body 1. The adjusting screw 72 is fastened to cause the diameter of the chuck section at the rear end of the needle chuck 70 to reduce size. The needle 7 inserted into the middle hole of the needle chuck 70 is fastened and held under a state in which approximately ⅓ of the rear end extends from the adjusting screw 72 toward a rearward section.

The needle chuck 70 is always biased in a forward direction by the biasing force of the coil spring 73 resiliently installed at the middle section in the air brush main body 1. Additionally, an operating plate 71, bent substantially in an S-shape, is placed between the front end of the needle chuck 70 and the operating lever 4.

Thus, when the operating lever 4 is pulled in a rearward direction against the biasing force of the coil spring 73 and slanted, the chuck 70 and the needle 7 are slid in a rearward direction through the operating plate 71, and the nozzle 2 at the front end of the air brush main body 1 is opened. The coating material, flowing down from the coating material container 3, is injected or blown out of the nozzle 2.

That is, the air brush is constructed such that, as the operating lever 4 is pushed down, the injection of the compressed air from the nozzle 2 is started, and the operating lever 4 is pulled rearwardly and slanted to cause the coating material to be blown and injected from the nozzle 2.

Figure 3:
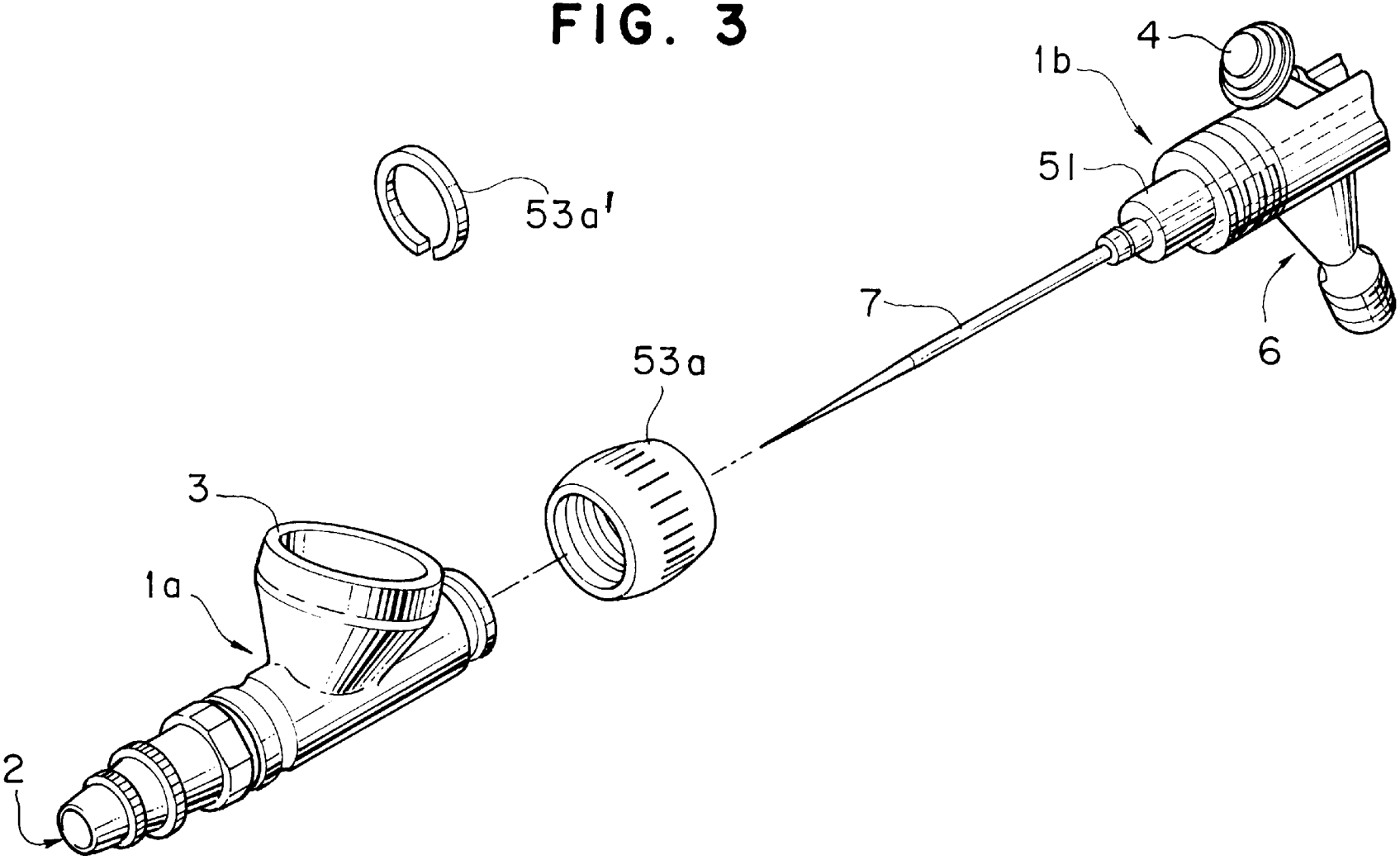
FIG. 3 is a perspective view showing a state in which the air brush is divided from the separating section.

As described above, the air brush main body 1 is separated from the separating section (a), arranged between the mounting section for the coating material container 3 and the mounting section for the air supplying port 6. The main body 1 can be separated into a nozzle container unit 1*a* at the extremity end of the main body and a main body unit 1*b* at the rear section of the main body 1 (FIG. 3).

At the extremity end of the main body unit, a short shaft fitted convex section 51 projects therefrom in two steps. An O-ring 51*a*, for water-tight holding action, is fitted and installed at an outer circumference of a small-diameter part of the extremity end of the fitted convex part 51. In addition, a female threaded part 53*b* is formed at an outer circumferential surface of the extremity end of the main body unit 1*b*.

A fitting hole 52 is formed in a rear end port of the nozzle container unit 1*a*.

A water-tight sealing O-ring 52*a* is fitted to an inner circumference of the fitting hole 52, and the fitting convex section 51 of the main body unit 1*b* is fitted and inserted into the fitting hole 52 the shapes coinciding with each other. In addition, a ring nut 53*a* through a C ring 53*a'* is rotatably installed at an outer circumference of the rear end section of the nozzle container unit 1*a'*. The nozzle container unit 1*a* and the main body unit 1*b* are coaxially connected to each other by fitting the fitting hole 52 of the separating section (a) to the fitting convex part 51. Air-tightness at the fitted sections is held via the O-rings 51*a*, 52*a*.

Additionally, the above units 1*a*, 1*b* may be made inseparable by threadably fitting the ring nut 53*a* at the outer circumference part to the female threaded section 53*b*, i.e., when the ring nut 53*a* is properly fastened, the nozzle container unit 1*a* is fixed unrotationally.

In addition, in the embodiment described above, although a structure in which the fastening of the ring nut 53*a* acts as a means for fixing the nozzle container unit 1*a* at an optional fixing angle, the structure for fixing the fixing angle of the nozzle container unit is not restricted to the structure in which the ring nut 53*a* is used. That is, any structure may be employed if the nozzle container unit can be fixed thereby at optional fixing angle.

A clearance of an appropriate size is provided between an end surface of the stepped section of the fitting hole 52 of the nozzle container unit 1*a* and an end surface of the stepped section of the main body unit 1*b*. Accordingly, a ring-like air chamber (b) is formed between both end surfaces of the stepped section while the units 1*a*, 1*b* are fitted and connected.

The air chamber (b) is formed in an annular shape when the units 1*a*, 1*b* are connected to each other. End openings of the aeration passage 9*a* communicate with the nozzle 2 at the extremity end of the nozzle container unit 1*a*, while an aeration passage 9*b* communicates with the air supplying port section 6.

The nozzle container unit 1*a* and the main body unit 1*b* are separated by disengaging the ring nut 53*a* at the separating section (a) from the female threaded section 53*b*.

The separated units 1*a*, 1*b* are constructed such that the aeration passages 9*a*, 9*b* or the insertion section of the needle 7 can be seen from the end surface of the separating section (a). Accordingly, when compared with the prior art brush where maintenance is mainly carried out through the opening of the nozzle side end of the air brush main body, inspection or cleaning operation may be performed quite easily and the ease of maintenance is improved.

As described above, the nozzle container unit 1*a* and the main body unit 1*b* removably connected to each other at the separating section (a) can be set such that the nozzle container unit 1*a* can be rotated around an axial core section of the air brush main body 1 through a fitted state between the fitted convex section 51 and the fitted hole 52 as the fastening with the ring nut 53*a* is released.

That is, the air brush main body 1 is set such that when a fixing angle of the nozzle container unit 1*a* around an axial core is optionally changed and the ring nut 53*a* is properly fastened, the nozzle container unit 1*a* can be fixed at a desired angle.

Figure 4:
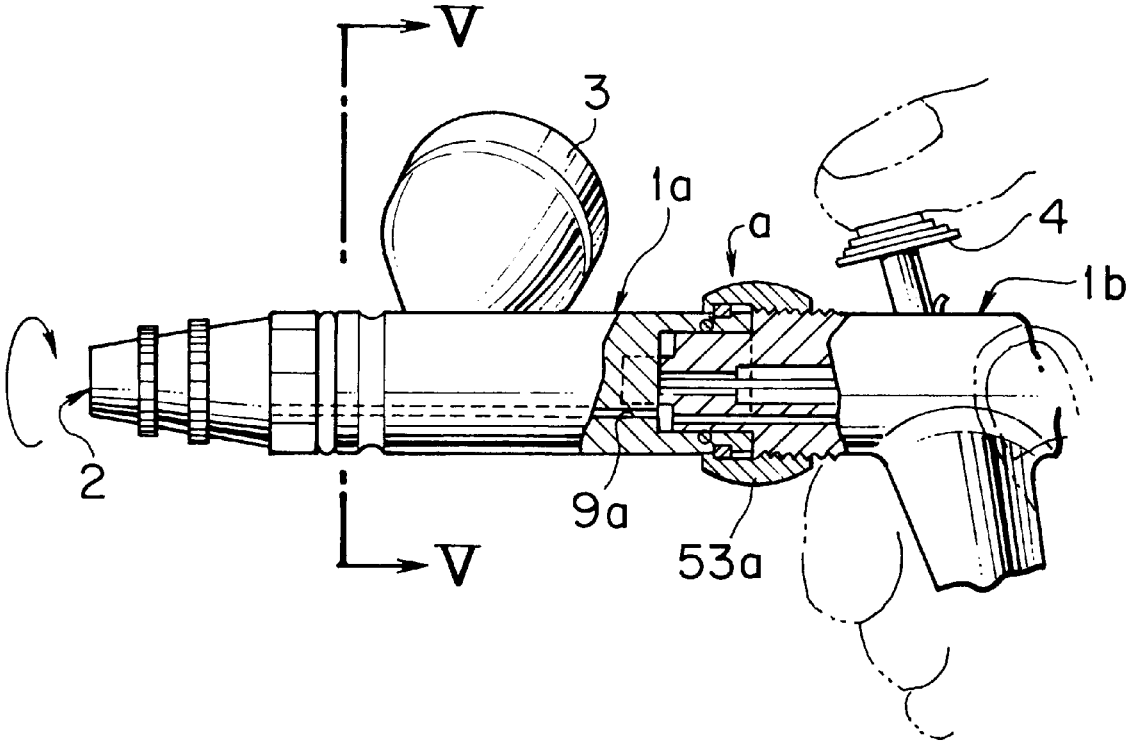
FIG. 4 is a side elevational view partly cut-away of the air brush under a state in which the nozzle container unit is inclined.
Figure 5:
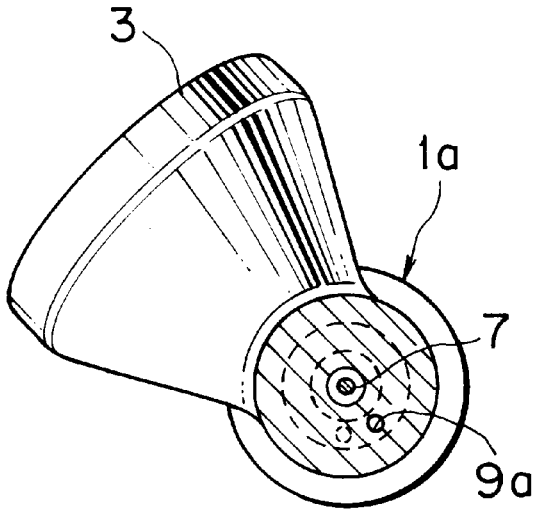
FIG. 5 is a sectional view taken along a line V—V in FIG. 4.

Normally, although the coating material container 3 arranged at the extremity end of the air brush main body 1 is positioned at the central part of an upper section of the air brush main body 1, changing the fixing angle of the nozzle container unit 1*a* as described above enables the position of the coating material container 3 of the nozzle container unit 1*a* to be inclined from the central part of the upper section of the main body 1 to the rightward or leftward side (FIGS. 4 and 5).

When the coating material container is positioned at the central section of the upper part of the extremity end of the air brush main body (as found in the prior art air brush) it is sometimes found that the coating material may hinder blowing injection work. To address this problem in the present device, the fixing angle of the nozzle container unit 1*a* is displaced to include the coating material container 3 in a rightward direction (or in a leftward direction for a left-handed person). It is thereby possible to perform the work while directly seeing the coating material injected from the nozzle 2, and the workability is remarkably improved.

Figure 6:
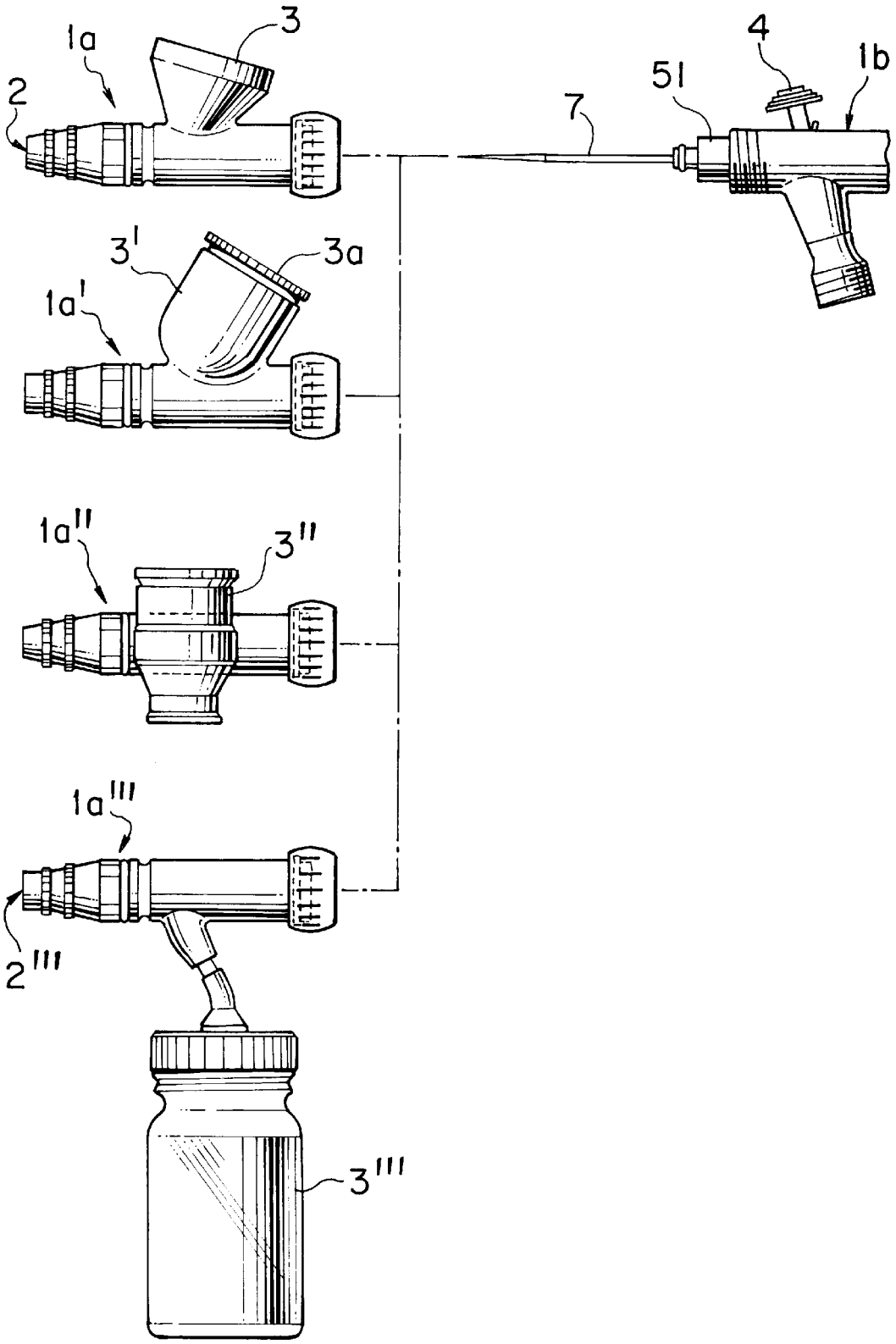
FIG. 6 is a side elevational view showing the air brush comprised of one main body unit and four kinds of nozzle container units.

Although the air brush is constructed such that the air brush main body 1 is formed by combining the nozzle container unit 1*a* with the main body unit 1*b* in an opposed relationship, the air brush of the present invention may be constructed such that one main body unit 1*b* and a plurality of kinds of nozzle container units 1*a* are combinable with each other, as shown in FIG. 6.

The air brush shown in FIG. 6 includes a main body unit 1*b* and four kinds of nozzle container units 1*a* to 1*a*'''. The four kinds of nozzle container units 1*a* to 1*a*''' have different kinds of containers and different nozzle diameters, and may be optionally replaced and installed in respect to one main body unit 1*b*.

The aforementioned main body unit 1*b* is constructed in quite the same manner as that previously described.

In turn, although the nozzle container units 1*a* to 1*a*''' are of common basic structures, their nozzle diameters are different, as are the configurations of the coating material containers 3 to 3'''.

The nozzle container unit 1*a* is provided with a relatively small weight type container 3. The nozzle container unit 1*a*' is provided with a slightly larger container 3', wherein a cap 3*a* is fitted and installed at its opening. The nozzle container unit 1*a*'' is constructed such that a container 3'' is separately formed and connected to the nozzle rear section from the side surface thereof. The nozzle container unit 1*a*''' is provided with a suction type bottle container 3''', and the diameter of the nozzle 2''' is set slightly larger.

In addition, although each of the nozzle container units 1*a*' to 1*a*''' has a different shape of the container or a different nozzle diameter, respectively, other basic constitutions are similar to that of the nozzle container unit 1*a* previously described. For example, the ring nut 53*a* at the rear end of the unit or the connecting structure in the fitted hole 52 is constituted in the same size as that of the aforementioned nozzle container unit 1*a*, and further, constructed such that each nozzle container unit can be removably connected to the extremity end of the main body unit 1*b*.

In the aforementioned air brush, the most suitable nozzle container unit is selected from the units 1*a* to 1*a*''', and the unit is replaced and installed according to a particular desired operation. Accordingly, four kinds of injecting functions can be optionally used. That is, it is possible to perform the blowing injection work in the same manner as that for which four different kinds of air brushes can be used separately.

Any type of existing structure of the connecting section between the main body unit 1*b* and each of the nozzle container units 1*a* to 1*a*''' may be employed if both units 1*a*, 1*b* can be removably connected and separated.

In addition, the air brush of the preferred embodiment is constructed as a combination of one main body unit 1*b* and four kinds of nozzle container units 1*a* to 1*a*'''. The present invention is not limited to four kinds of nozzle container units, but may be constituted such that a plurality of kinds of nozzle container units can be replaced with and fixed to one main body unit. That is, two or more nozzle container units can be prepared. In addition, any type of configuration of a respective nozzle unit may be applied if the nozzle unit can be connected to one main body unit.

As described above, when any one of the nozzle container units 1*a* to 1*a*''' is to be replaced and a new one connected to the main body unit 1*b*, the ring nut 53*a* is loosened to separate the already installed nozzle container, e.g., unit 1*a*, from the main body unit 1*b* if the nozzle container unit of the nozzle container unit.

Then, the replacement nozzle container unit, for example, the nozzle container unit 1*a*', is fitted and connected to the main body unit 1*b* and the ring nut 53*a* is threadably fitted.

As described above, the nozzle container unit 1*a*' to be replaced and installed is set such that a fixing angle around an axial core in respect to the main body unit 1*b* can be optionally adjusted in the same manner as that of the nozzle container unit 1*a*.

The replacing operation for the nozzle container units 1*a* to 1*a*''' in respect to the main body unit 1*b* is basically carried out in the described order. However, when the nozzle container units 1*a* to 1*a*''' are actually replaced and installed, the needle 7 is at first retracted a little before the replacing operation in order to prevent the extremity end of the needle 7 from being damaged.

In addition, since the nozzle container units 1*a* to 1*a*''' are slightly different in the inserting size of the extremity end of the needle 7, due to a difference in diameter of the nozzle 2 or size tolerance, it is necessary to adjust the needle 7 after the replacement and installing operation.

In this case, in order to change the fixed position of the needle 7 as described above, the adjustment screw 72 (placed in the cap member 10 at the rear section of the main body unit 1*b*) is loosened. The rear end of the needle 7 is then held by hand and displaced rearwardly.

The air brush of the embodiment is constructed such that the cap member 10 connected to the rear section of the main body unit 1*b* is provided with openings 10*a*, 10*b*. The adjustment screw 72 and the rear section of the needle 7 can be held directly by hand through the openings 10*a*, 10*a* while the cap member 10 is being fixed to the main body unit 1*b*.

Figure 7:
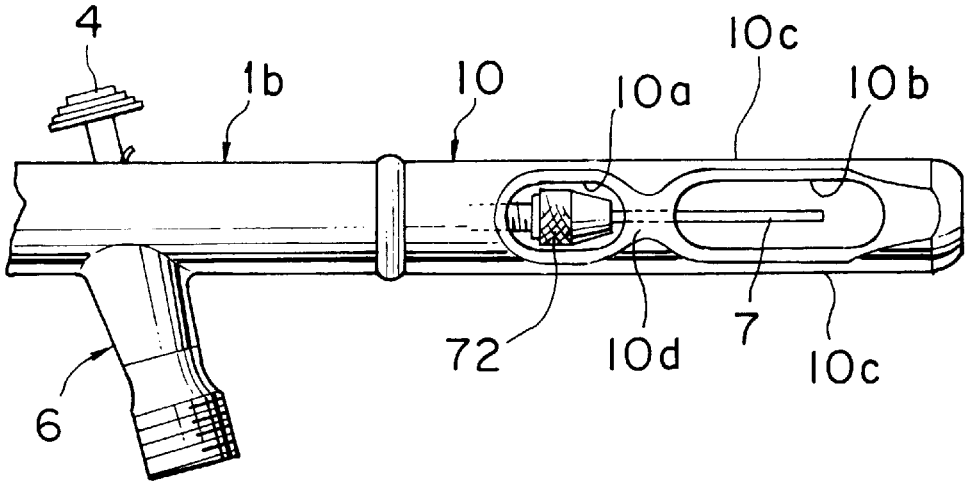
FIG. 7 is a side elevational view for showing a rear section of the air brush main body.
Figure 8:
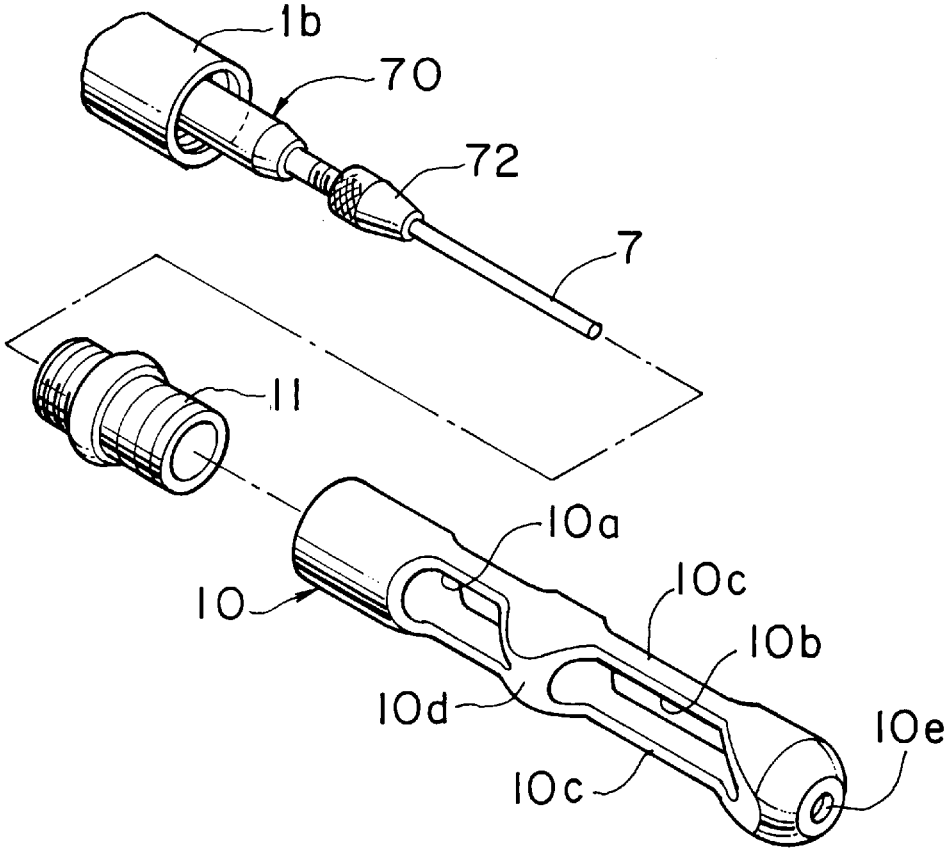
FIG. 8 is an exploded perspective view showing the rear section of the air brush main body.

As shown in FIGS. 7 and 8, to the rear end of the aforesaid air brush main body 1 is connected the cap member 10, covering the adjustment screw 72 and the rear section of the needle 7.

The cap member 10 includes a cylinder closed at its rear end port. A screw cylinder 11 is threadably fitted in the rear end port of the main body unit 1*b* and is integrally fitted to the front end port. In addition, the openings 10*a*, 10*b* open at corresponding positions to the adjustment screw 72 and the rear section of the needle 7 at the peripheral wall of the cap member 10.

Figure 9:
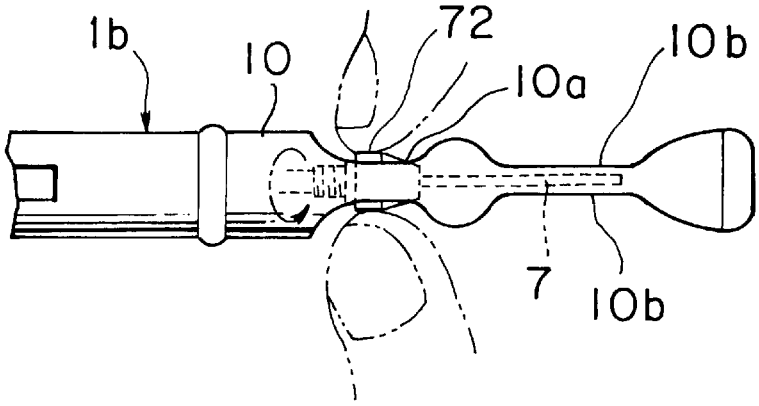
FIG. 9 is a top plan view showing a cap body member of the air brush.
Figure 10:
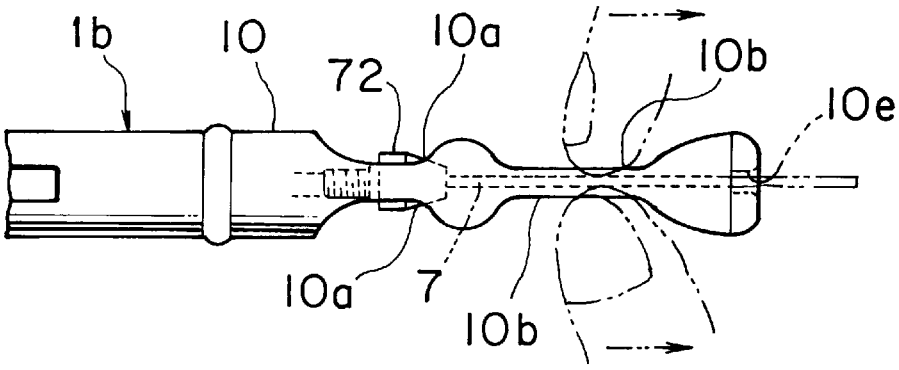
FIG. 10 is a top plan view showing the cap body section of the air brush under a state in which the needle is retracted.

Each of the openings 10*a*, 10*b* of the cap member 10 opens at opposing right and left side surfaces at the peripheral wall of the cap member 10. Fingers are inserted into the openings 10*a*, 10*b* to hold the adjustment screw 72, and the rear section of the needle 7 positioned at the axial core section in the cap member 10 (FIGS. 9 and 10).

Thus, the air brush can freely perform an operation for loosening or fastening the adjustment screw 72 by inserting fingers through the openings 10*a*, 10*b* while the cap member 10 is being fixed, and may also perform the operation in which the needle 7 is axially slid.

As described above, when the system in which the cap member 10 installed at the rear end of the main body unit 1*b* has openings 10*a*, 10*b*, it is possible to quickly adjust the needle 7 while holding the adjustment screw 72 and the rear section of the needle 7 through the openings 10*a*, 10*b* while the cap member 10 is being fixed, even when the adjustment of the needle 7 is required in order to replace and install the nozzle container units 1*a* to 1*a*'''. As a result, it is possible to perform the replacing operation of the nozzle container units 1*a* to 1*a*''' smoothly when the adjustments for the needle 7 are performed as a series of operations.

As described above, the cap member 10 having the openings 10*a*, 10*b* includes the two connecting segments 10*c* extending along a vertical plane and a partition section 10*d* between both openings 10*a*, 10*b*, these walls protecting the rear section of the needle 3.

In addition, a pass-through hole 10*e* is formed at the axial core at the rear end surface of the cap member 10. With this arrangement, the needle 7 may be slid rearwardly after inserting the fingers through the opening 10*b* (as described above) and pulled out of the pass-through hole 10*e*. Additionally, the removed needle 7 may be inserted through the through-pass 10*e* to install the needle 7 in the needle chuck 70.

In the described air brush, although the openings 10*a*, 10*b* of the cap member 10 are positioned at both right and left sides while the cap member 10 is threadably engaged at the rear end surface of the main body unit 1*b*, the positions of the openings 10*a*, 10*b* may be set other than both right and left side surfaces, and for example, the openings 10*a*, 10*b* may be directed in a vertical direction.

Figure 11:
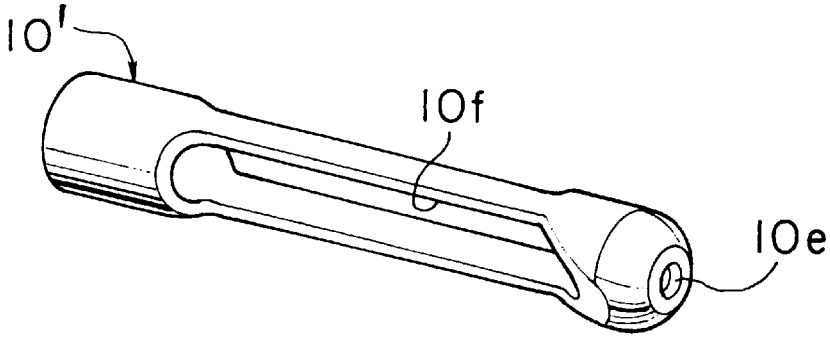
FIG. 11 is a perspective view showing a cap in which the opening is fully cut and opened.
Figure 12:
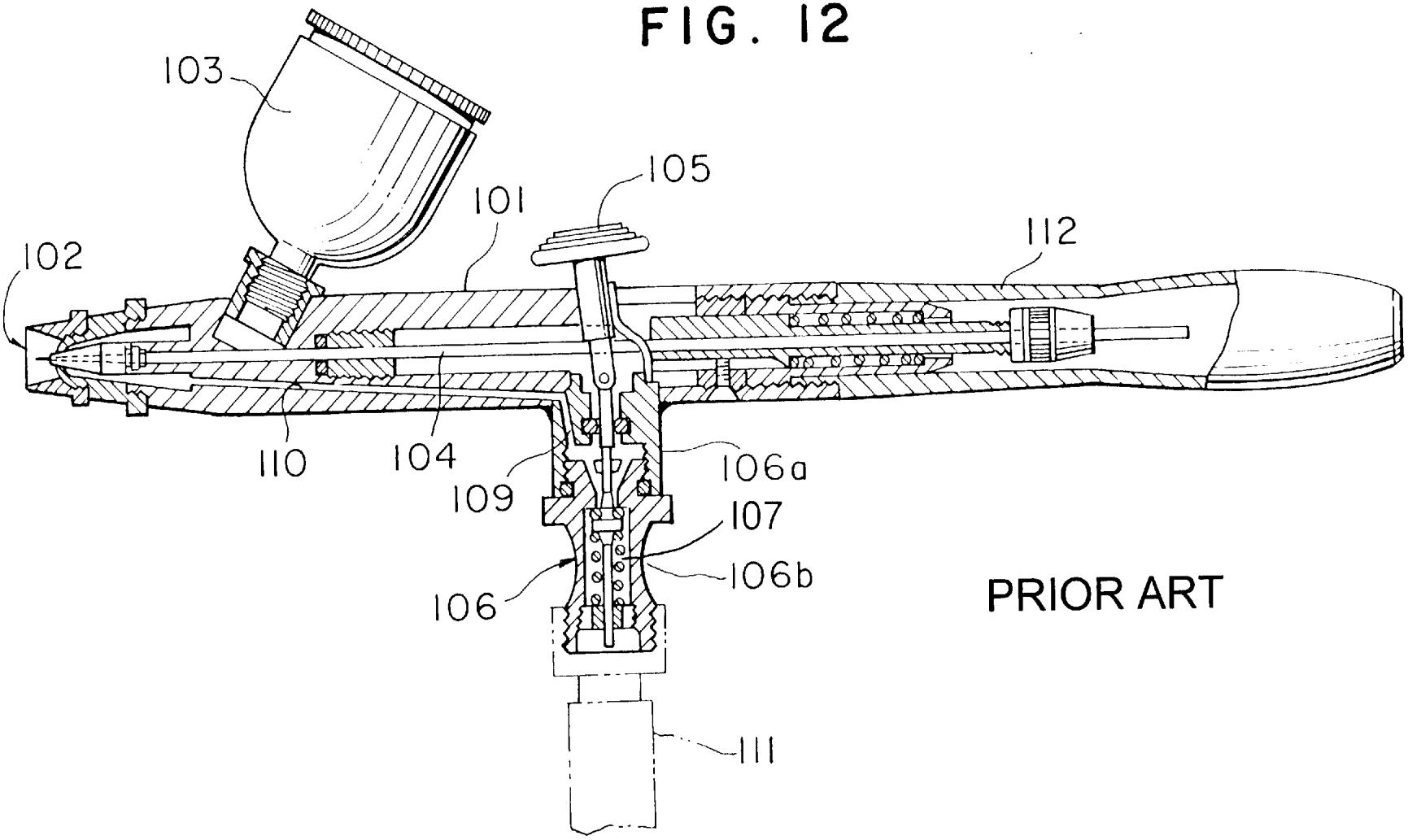
FIG. 12 PRIOR ART
FIG. 12 is a longitudinal section showing the prior art air brush.

The openings in the preferred embodiment are set such that they are separated with the opening 10*a* corresponding to the adjustment screw 72 and the opening 10*b* corresponding to the rear segment of the needle 7. However, the opening at the cap member 10 may be entirely open from the front segment of the cap member 10' to its rear segment, as indicated at the opening 10*f* of the cap member 10' shown in FIG. 11.

As described above, the present invention is constructed such that the air brush main body is divided between the mounting section of the coating material container and the mounting section of the air supplying port, and the nozzle container unit at the leading end of the main body and the residual main body unit can be separated from the separating section and connected. Accordingly, when the air brush main body is processed with maintenance work, the air brush main body is separated from the divided segment to enable inspection and cleaning for an aeration passage or a needle insertion hole. That is, inspection into the separated segment between the aforesaid nozzle container unit and the main body unit is easily carried out.

In addition, machining for the aeration hole or the needle insertion hole may also be easily carried out, using the openings acting against the aforesaid dividing section.

The air brush includes one main body unit and a plurality of nozzle container units having different configurations, wherein optional nozzle container unit can be replaced with and installed against the aforesaid main body unit, so that the most suitable one is selected from the nozzle container units having different forms of the coating material containers or different nozzle diameters, replaced with and installed, thereby a plurality of kinds of blowing forms can be selectively used.

Accordingly, as compared with the case in which a plurality of air brushes as found in the prior art are prepared, it has a function to perform a selective utilization of a plurality of kinds of blowing forms, the component parts can be reduced with a common use of one main body unit, thereby it is possible to realize the method of selective use of a plurality of kinds of blowing forms in a low cost.

The air brush is constructed such that a fixing angle of the nozzle container unit around an axial core of the air brush main body can be variably adjusted in respect to the main body unit, so that a fixing angle of the nozzle container unit in respect to the main body unit can be variably adjusted.

For example, even if the coating material container becomes a hindrance due to a certain degree of visual angle, the fixing angle of the nozzle container unit is displaced as described above to cause the coating material to be inclined in a rightward or leftward direction as described above and it becomes possible to perform a blowing operation while directly seeing the nozzle section and the convenience in blowing operation can be improved.

The air brush is constructed such that an annular air chamber is formed between the connecting surfaces of the separating section of the air brush main body, the aeration passage at the main body unit and the aeration passage at the nozzle container unit are communicated through the air chamber, so that even if the fixing angle of the nozzle container unit in respect to the main body unit is changed as described above, the aeration passage at the nozzle container unit side and the aeration passage at the main body unit are always kept in their communicated state and then supplying of the compressed air can be carried out without any trouble.

The air brush is made such that the cap member covering the adjustment screw and the rear part of the needle is removably connected to the rear section of the main body unit, and the openings for operation are opened at positions corresponding to the adjustment screw in the aforesaid cap member and the rear section of the needle.

Accordingly, when the nozzle container unit is replaced and installed as described above, the aforesaid adjusting operation can be easily carried out while the adjustment screw and the rear section of the needle are being directly held with fingers under a state in which the adjustment work for the needle is required in compliance with the nozzle container unit without removing the cap member from the main body unit, resulting in that a replacing work for the nozzle container unit can be performed within a short period of time.

Having described specific preferred embodiments of the invention with reference to the accompanying drawings, it will be appreciated that the present invention is not limited to those precise embodiments, and that various changes and modification can be effected therein by one of ordinary skill in the art without departing from the scope or spirit of the invention as defined by the appended claims.

What is claimed is:

1. An air brush system, comprising:

a main body portion including:

an air supplying port mounted to said main body portion;

a separating section end;

a nozzle container unit including:

a nozzle;

a coating material container mounted to said nozzle container unit;

a separating section connection;

said separating section connection of said nozzle container unit being removably attachable to said separating section end of said main body portion, forming an air brush with said separating section end and said separating section connection between said coating material container and said air supplying portion.

2. The air brush system according to claim 1, wherein said air brush system comprises a plurality of said nozzle container units having differing nozzles and differing coating material containers but identical separating section connections matching said separating section end of said nozzle container unit.

3. The air brush system according to claim 2, each of said main body portion and said nozzle container unit having an axial core, and said air brush system further comprising:

an elongated needle extending through said respective axial cores, said elongated needle having an adjustment screw and a projecting rear section at a rear portion of said main body portion for adjusting an axial position of said elongated needle; and a cap member generally covering said adjustment screw and said projecting rear section, said cap member having at least one opening allowing manipulation of said adjustment screw and said projecting rear section.

4. The air brush system according to claim 1, further comprising a coupling member detachably attaching said separating section end and said seperating section connection.

5. The air brush system according to claim 4, said coupling member mounted to said separating section and threadedly engageable with said separating section connection of said nozzle container unit.

6. An air brush system, comprising:

a main body portion including:

an air supply port mounted to said main body portion;

a separating section end;

a nozzle container unit including:

a nozzle;

a coating material container mounted to said nozzle container unit;

a separating section connection;

said main body portion and said nozzle container unit each having a longitudinal axis, said separating section connection of said nozzle container unit being removably attachable to said separating section end of said main body portion with said longitudinal axis of said nozzle container unit coaxially aligned with said longitudinal axis of said main body unit at a variable angle of said nozzle container unit about said longitudinal axis of said main body unit; and said separating section connection of said nozzle container unit being removably attachable to said separating section end of said main body portion, and forming an air brush with said separating section end and said separating section connection between said coating material container and said air supply end portion.

7. The air brush system according to claim 6, each of said main body unit and said nozzle container unit having an axial core, and said air brush system further comprising:

an elongated needle extending through said respective axial cores, said elongated needle having an adjustment screw and projecting rear section at a rear portion of said main body unit for adjusting an axial position of said elongated needle; and a cap member generally covering said adjustment screw and said projecting rear section, said cap member having at least one opening allowing manipulation of said adjustment screw and said projecting rear section.

8. The air brush system according to claim 6, at least one of said separating section end and said separating section connection having an annular air chamber formed in a surface at which said separating section connection is removably attachable to said separating section end, and each of said main body portion and said nozzle container unit having an aeration passage to said annular air chamber when said separating section connection is removably attachable to said separating section end, so that said respective aeration passages are connected at any said variable angle of said nozzle container unit about said longitudinal axis of said main body unit.

9. The air brush system according to claim 8, each of said main body portion and said nozzle container unit having an axial core, and said air brush system further comprising:

an elongated needle extending through said respective axial cores, said elongated needle having an adjustment screw and a projecting rear section at a rear portion of said main body portion for adjusting an axial position of said elongated needle; and a cap member generally covering said adjustment screw and said projecting rear section, said cap member having at least one opening allowing manipulation of said adjustment screw and said projecting rear section.

10. The air brush system according to claim 6, said air brush system further comprising a plurality of said nozzle container units having different nozzles and different coating material containers but identical separating section connections matching said separating section end of said nozzle container unit.

11. The air brush system according to claim 10, said main body portion and said nozzle container unit each having an axial core, said air brush system further comprising:

an elongated needle extending through said axial cores of said main body portion and said nozzle container unit, said elongated needle having an adjustment screw and a projecting rear section at a rear portion of said main body portion for adjusting an axial position of said elongated needle; and a cap member generally covering said adjustment screw and said projecting rear section, said cap member having at least one opening allowing manipulation of said adjustment screw and said projecting rear section.

12. The air brush system according to claim 6, further comprising a coupling member detachably attaching said separating section end and said separating section connection.

13. The air brush system according to claim 12, said coupling member mounted to said separating section and threadedly engageable with said separating section connection of said nozzle container unit.

14. An air brush system, comprising:

a main body portion including:

an air supply port mounted to said main body portion;

a separating section end;

a nozzle container unit including:

a nozzle;

a coating material container mounted to said nozzle container unit;

a separating section connection;

said main body portion and said nozzle container unit each having an axial core;

an elongated needle extending through said axial cores of said main body portion and said nozzle container unit, said elongated needle having an adjustment screw and a projecting rear section at a rear portion of said main body portion for adjusting an axial position of said elongated needle; and a cap member generally covering said adjustment screw and said projecting rear section, said cap member having at least one opening allowing manipulation of said adjustment screw and said projecting rear section;

said separating section connection of said nozzle container unit being removably attachable to said separating section end of said main body portion, forming an air brush with said separating section end and said separating section connection between said coating material container and said air supplying portion.

15. The air brush system according to claim 14, said air brush system comprising a plurality of nozzle container units having different nozzles and different coating material containers but similar separating section connections matching said separating section end of said nozzle container unit.

16. The air brush system according to claim 14, at least one of said separating section end and said separating section connection having an annular air chamber formed in a surface at which said separating section connection is removably attachable to said separating section end, and each of said main body portion and said nozzle container unit having an aeration passage to said annular air chamber when said separating section connection is removably attachable to said separating section end, so that said respective aeration passages are connected at any angle of said nozzle container unit about said longitudinal axis of said main body unit.

17. The air brush system according to claim 14, further comprising a coupling member detachably attaching said separating section end and said separating section connection.

18. The air brush system according to claim 17, said coupling member mounted to said seperating section and threadedly engageable with said separating section connection of said nozzle container unit.

* * * * *

UNITED STATES PATENT AND TRADEMARK OFFICE

CERTIFICATE OF CORRECTION

PATENT NO. : 5,961,050
DATED : October 5, 1999
INVENTOR(S) : K. Kitajima

It is certified that error appears in the above-identified patent and that said Letters Patent is hereby corrected as shown below:

Column 12
Line 4 (claim 7, line 2), of the printed patent, "unit" should be -- portion --.
Line 8 (claim 7, line 6), of the printed patent, before "projecting" insert -- a --.
Line 9 (claim 7, line 7), of the printed patent, "unit" should be -- portion --.

Column 11,
Line 40 (claim 4, line 3), of the printed patent, -- separating --.

Column 14,
Line 24 (claim 18, line 2), of the printed patent, "seperating" should be -- separating --.

Signed and Sealed this

Ninth Day of October, 2001

*Attest:*

Nicholas P. Godici

*Attesting Officer*

NICHOLAS P. GODICI
*Acting Director of the United States Patent and Trademark Office*